US005481769A

United States Patent [19]

Schneider

[11] Patent Number: 5,481,769

[45] Date of Patent: Jan. 9, 1996

[54] LIFTING APPARATUS

[75] Inventor: Johannes Schneider, Bünde, Germany

[73] Assignee: Dewert Antriebs- U. Systemtechnik GmbH & Co KG, Kirchlengern, Germany

[21] Appl. No.: 180,876

[22] Filed: Jan. 12, 1994

[30] Foreign Application Priority Data

Jan. 15, 1993 [DE] Germany ..... 9300438 U

[51] Int. Cl.[6] ..... A61G 7/00

[52] U.S. Cl. ..... 5/617; 5/616; 5/424

[58] Field of Search ..... 5/13, 616, 617, 5/425; 464/39; 254/7 R, 7 B, 7 C

[56] References Cited

U.S. PATENT DOCUMENTS

| | | | |
|---|---|---|---|
| 2,714,436 | 8/1955 | Heisler | 464/39 X |
| 2,983,122 | 5/1961 | Polzin | 464/39 |
| 3,050,923 | 8/1962 | Sanderson | 464/39 X |
| 4,407,030 | 10/1983 | Elliott | 5/616 |
| 4,463,463 | 8/1984 | Kaneko | 5/616 |
| 4,534,077 | 8/1985 | Martin | 5/616 X |
| 5,129,116 | 7/1992 | Borders et al. | 5/617 |
| 5,224,228 | 7/1993 | Larrimore | 5/613 |
| 5,305,482 | 4/1994 | Dewert | 5/616 |
| 5,317,769 | 7/1994 | Weismiller et al. | 5/616 X |

FOREIGN PATENT DOCUMENTS

| | | |
|---|---|---|
| 0505847 | 9/1992 | European Pat. Off. . |
| 2934396 | 3/1981 | Germany . |
| 290741 | 6/1991 | Germany . |
| 9103817 | 8/1991 | Germany . |
| 4113598 | 10/1992 | Germany . |
| 644011 | 7/1984 | Switzerland . |
| 1027600 | 4/1966 | United Kingdom . |

*Primary Examiner*—Michael F. Trettel
*Attorney, Agent, or Firm*—Henry M. Feiereisen

[57] ABSTRACT

A lifting device for swiveling a part of a piece of furniture includes a scissor jack attached to the part being swiveled and operated by a drive unit having a spindle and a gear motor which is connected to the scissor jack and runs along the spindle. Incorporated in the drive unit is a safety mechanism for stopping a movement of the scissor jack upon occurrence of a blockage. The safety mechanism includes a pair of disks rotatable about the spindle and engaging each other via a complementary tooth gearing provided about the perimeter of each disk. One disk is stationary and the other disk is a spring-loaded disk which is displaceable in axial direction relative to the one disk. In this manner, the disks can be disengaged upon blockage during downward movement of the scissor jack to disconnect the gear motor from its output element and to prevent a further movement of the scissor jack.

13 Claims, 3 Drawing Sheets

LIFTING APPARATUS

BACKGROUND OF THE INVENTION

The present invention refers to a lifting apparatus for swiveling parts of a piece of furniture, and in particular to a lifting apparatus of the type having a scissor jack and an electromotive drive unit essentially including a threaded spindle and a gear motor.

German publication DE-GM 91 03 817 describes a lifting apparatus of this type having a d.c. gear motor with an output link in form of a rotatably driven screw nut with female threaded to allow the d.c. gear motor to shift along a stationary threaded spindle. Depending on the direction of movement of the d.c. gear motor, the scissor jack with its scissors-type members collapses or moves apart. Even though this lifting apparatus has proven reliable, practice has shown that the scissor jack has the tendency to selfcontract over a portion of the lift, thus creating a danger of injury or damage. This danger is however not only caused by the scissor jack but may also be triggered by the furniture part being swiveled, e.g. the foot part or the head part of a slatted base. In addition, this lifting apparatus has the drawback that the scissor jack or the furniture part being swiveled suddenly drops once the obstruction has been removed.

SUMMARY OF THE INVENTION

It is thus an object of the present invention to provide an improved lifting apparatus for swiveling parts of a piece of furniture, obviating the afore-stated drawbacks.

It is a further object of the present invention to provide an improved lifting apparatus by which the danger of injury or damage in the area of the scissor jack as well as in the area of the continuously adjustable furniture part, e.g. the head part or the foot part of a slatted base of a bed or a chair, is eliminated.

It is yet another object of the present invention to provide an improved lifting apparatus by which a sudden drop of the scissor jack is prevented once an obstruction is removed from the movement path of the scissor jack.

These objects, and others which will become apparent hereinafter are attained in accordance with the present invention by providing the electromotive drive unit with a safety clutch essentially in form of two clutch disks, each including a peripheral tooth gearing, with one disk being stationary and the other disk being a spring-loaded disk secured to the threaded spindle to allow a movement in axial direction relative to the one disk so that the tooth gearings of the disks are in engagement at normal operation while being disengaged upon blockage during downward movement of the scissor jack due to a pressure force acting onto the spindle.

Through the provision of such a safety clutch, the lifting apparatus can be operated without risking any injury or damage by the swiveled furniture part and by the scissor jack.

The present invention is based on the teaching that the force exerted by the spring is sufficient to engage the tooth gearings of both clutch disks to thereby transmit a certain drive torque. In the event an object obstructs the lowering of the furniture part being swiveled or the collapse of the scissor jack, an axial force is exerted onto the threaded spindle to thereby axially shift the spindle and to separate or disengage both clutch disks. Thus, the transmission of the drive torque is interrupted, eliminating a danger of injury or damage. Once the object, e.g. a human hand, is removed from the path of movement of the scissor jack or the furniture part, the spring forces the tooth gearings of the disks to engage again so that the movement of the furniture part or scissor jack is immediately continued without encountering an abrupt or sudden drop of the furniture part.

Suitably, both clutch disks are designed in form of a ring gear. The manufacture of such clutch disks is especially simple because it is only required to provide the complementary circular surfaces with a respective tooth gearing.

According to another feature of the present invention, the scissor jack may be shielded from outside contact by providing a safety web which extends essentially over the entire width of the scissor jack. The provision of such a safety web particularly eliminates injury or damage by the scissor jack. The safety web is fixedly mounted with one end to the upper crossbar between the scissors-type members and secured with its other end to a winding reel. Thus, winding and unwinding of the safety web occurs in synchronism with the respective movement of the scissor jack. Suitably, the winding reel is provided with a spring which during unwinding of the safety web is tightened so as to automatically wind the safety web when the scissor jack is lowered.

In accordance with yet another embodiment of the present invention, a lifting apparatus includes a metallic scissor jack equipped with a sensor unit to form a contact or approximation detector which is operatively connected to a control and evaluator unit for converting signals generated by the sensor unit upon contact or approach of a metallic part of the scissor jack by an object into control signals for the electromotive drive of the scissor jack. The provision of such an electronic unit eliminates the use of any additional mechanical parts.

Suitably, the sensor unit and the control and evaluator unit are operatively connected to a switching amplifier for enhancing the control signals, with the switching amplifier incorporating the power supply so that the sensor unit as well as the control and evaluator unit are supplied with current only when the electromotive drive unit is operated.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
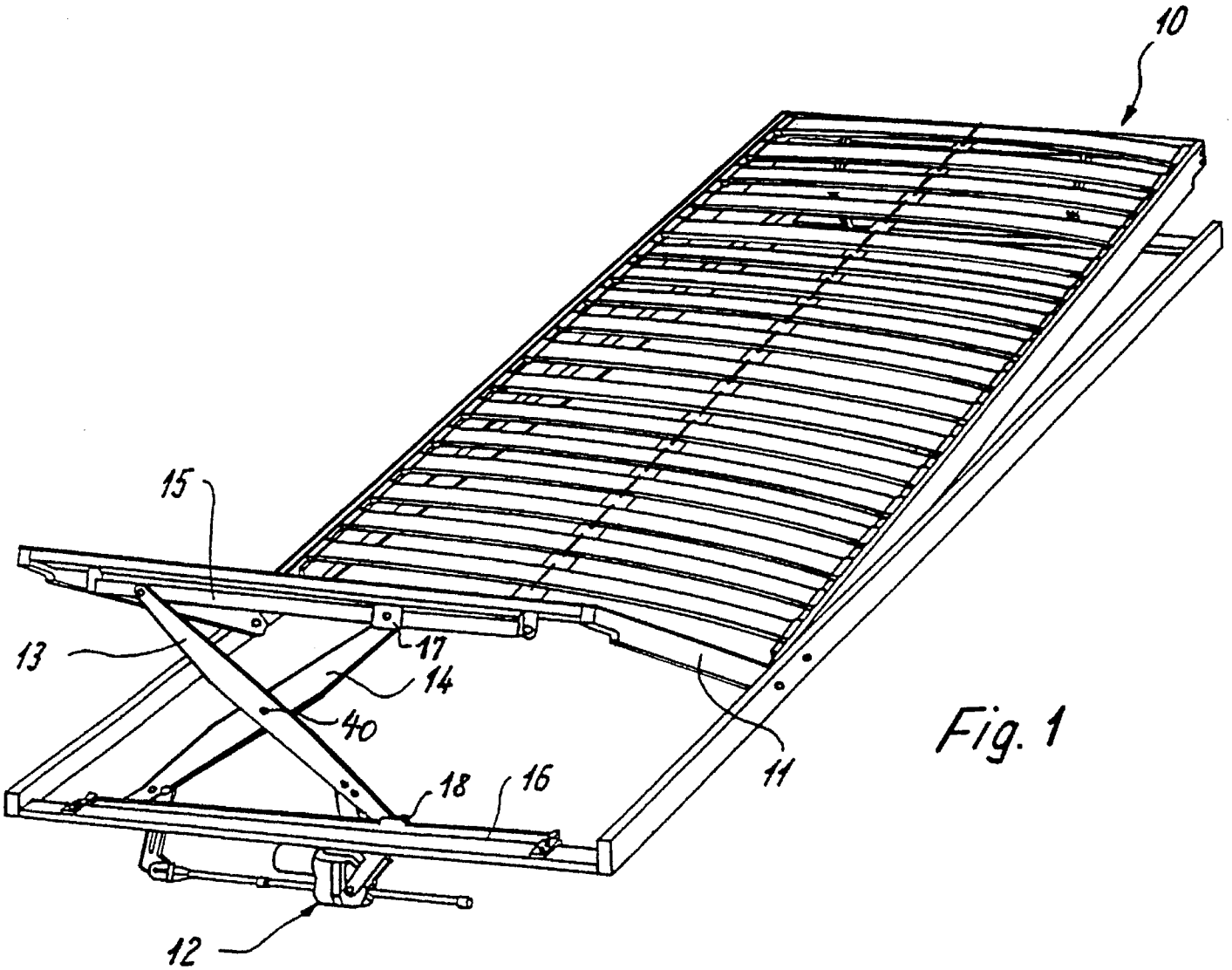
FIG. 1 is a perspective view of an exemplified slatted base equipped with a lifting apparatus according to the present invention.

Throughout all the Figures, the same or corresponding elements are always indicated by the same reference numerals.

Figure 2:
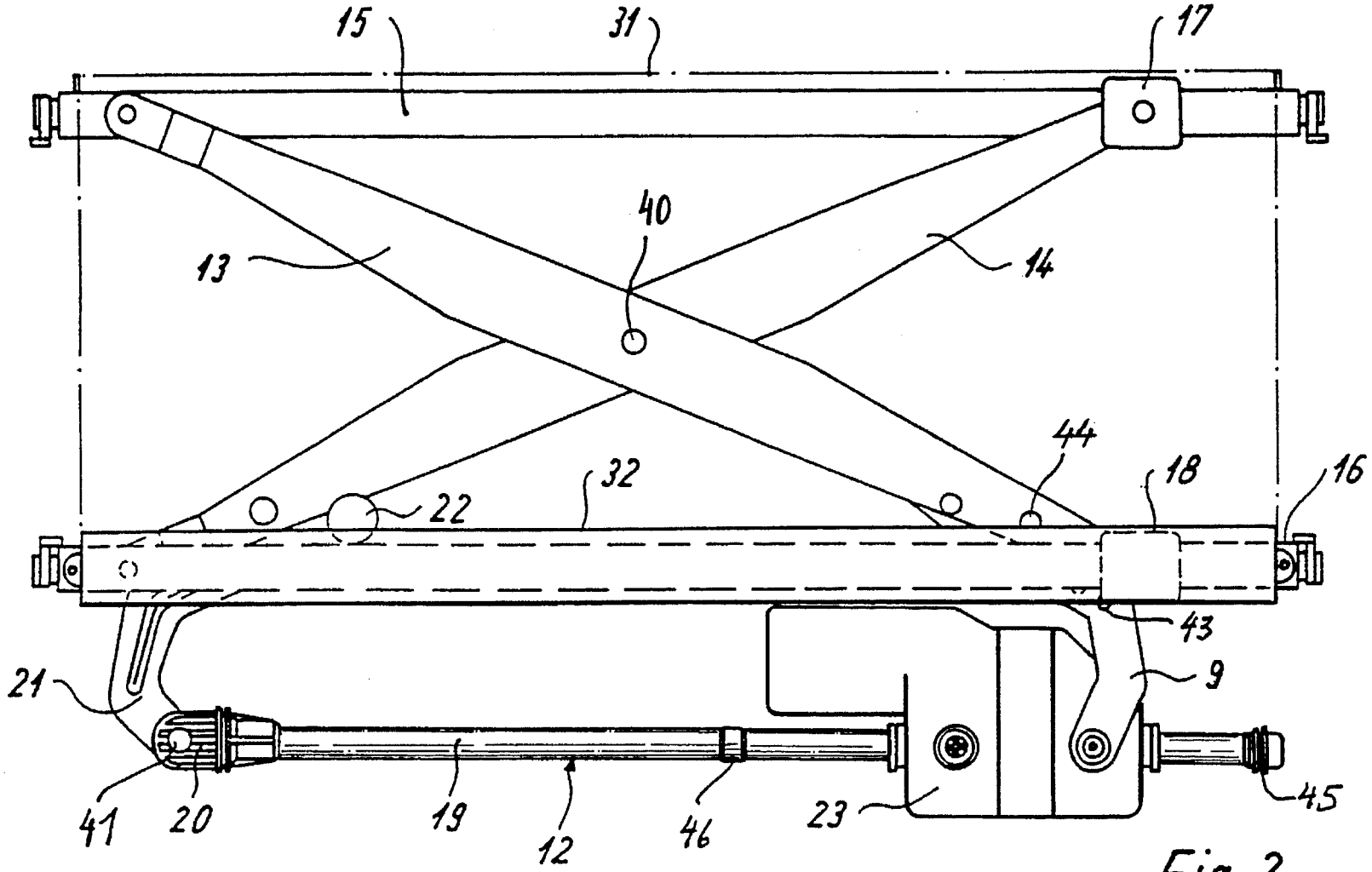
FIG. 2 is an enlarged elevational view of the lifting apparatus.

Referring now to the drawing, and in particular to FIG. 1, there is shown a perspective view of a slatted base, generally designated by reference numeral 10 and including a head part 11 which is swingable about a horizontal axis by means of a lifting apparatus, generally designated by reference numeral 12 and shown in more detail in FIG. 2. FIG. 1 also indicates that the section of the slatted base 10 extending from the head part 11 to the foot end is swingable about a horizontal axis. Persons skilled in the art will understand that the use of the lifting apparatus in connection with the slatted base 10 is done by way of example only and should not be limited thereto.

The lifting apparatus 12 includes a lifting unit in form of a scissor jack which essentially has two scissors-type members 13, 14 which are rotatably supported by a central bolt 40, and two crossbars 15, 16. In the non-limiting example of FIG. 1, the lower crossbar 16 is secured to the frame of the slatted base 10 while the upper crossbar 15 is mounted onto the head part 11, thus ensuring that the crossbars 15, 16 extend horizontally. With their one end (left end in FIG. 1), the scissors-type members 13, 14 are rotatably supported at the crossbars 15, 16, with the bearing points extending in the end areas. The other ends of the scissors-type members 13, 14 are rotatably mounted in sliders 17, which are movable along the crossbars 15, 16 so that these ends of the scissors-type members 13, 14 can be shifted in longitudinal direction of the crossbars 15, 16 when the scissor jack is moved apart or collapses.

Turning now to FIG. 2, there is shown an enlarged front elevational view of the lifting apparatus 12. In parallel relationship at a distance to the lower crossbar 16 is a nonrotatably secured horizontal threaded spindle 19 which has one end received in a fork head 20 that is hinged to an angle lever 21 via a bolt 41. The angle lever 21 is of two-armed configuration and rotatably supported in the end area of the scissors-type member 14 by bolt 42. The fork head distant end of the angle lever 21 supports a load transmission roller 22 which hooks underneath the scissors-type member 14 for supporting the upward movement of the scissor jack.

Placed on the threaded spindle 19 is a low-voltage d.c. gear motor 23. A lever-type mounting 9 links the gear motor 23 with the proximate end of the scissors-type member 13. In accordance with a nonlimiting example, the mounting 9 may include two cranked levers which are connected by screws (indicated at 43) and secured to the scissors-type member 13 via rivets 44. The low-voltage d.c. gear motor 23 has as output element a rotatably driven screw nut with female thread so that the gear motor 23 is shiftable along the spindle 19 for actuating the scissors-type members 13, 14 of the scissor jack in dependence on the running direction of the gear motor 23. Suitably, the movement of the gear motor 23 in either direction along the spindle 19 is limited through stop members 45, 46 which cooperate with suitable limit switches (not shown) inside the gear motor 23. The limit switches are actuated as soon as either of the stop members 45, 46 is touched. Advantageously, the stop member 46 is shiftably mounted on the spindle 19 to allow an adjustment of the lift of the scissor jack.

It is evident from FIGS. 1 and 2, that injury or damage may occur in particular when the scissor jack collapses and e.g. an object obstructs or a hand gets stuck in the path of movement of the swingable head part 11 or of the scissors-type members 13, 14. In order to prevent occurrence of injury or damage, a safety mechanism is therefore incorporated in the gear motor 23 for stopping the movement of the lifting apparatus 12 or the adjustment of the head part 11 under these circumstances, as will now be described in more detail with reference to FIG. 3.

The safety mechanism includes a safety clutch 24 which is placed between the output element (screw nut) and the gear motor 23 and essentially includes two clutch disks 25, 26, with one disk, e.g disk 26, being connected to the screw nut and the other disk operatively connected to the gear motor 23. The disk 25 is of substantially C-shaped configuration to form a recess for receiving the T-shaped disk 26. Both disks 25, 26 are rotatable about the spindle 19. A bearing bush **29*a* is secured in the housing 30 of the gear motor 23 to prevent an axial displacement of the disk 25. Received in a circumferential ring groove 28 of the disk 26 at the side distant to disk 25 is a disk spring 27 which bears upon an abutment in form of a bearing bush 29*b* to urge or press the disk 26 against the disk 25. The bearing bush 29*b* is suitably mounted in the housing 30** to prevent a displacement in axial direction thereof.

Figure 3:
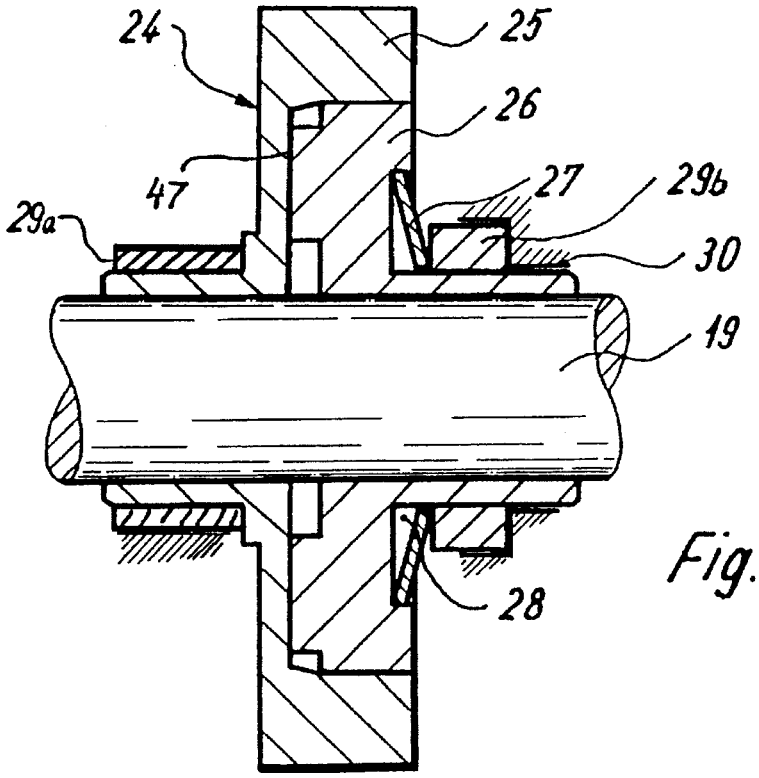
FIG. 3 is an enlarged cross-sectional view of a detail of the lifting apparatus.

Although not shown in detail, the contact surfaces of the disks 25, 26, indicated in FIG. 3 at 47 and extending perpendicular to the spindle 19, are provided with peripheral tooth gearings which engage each other. Thus, the disks 25, 26 bear upon each other in form-locking manner for transmitting the torque from the gear motor 23 to the output element (screw nut).

At normal operation of the scissor jack, the head part 11 can be upwardly folded through shift of the gear motor 20 along the stationary spindle 19 in direction toward the fork head 20, to thereby cause the scissors-type members 13, 14 to also move in direction of the fork head 20 since the gear motor 23 is securely connected to the scissors-type member 13 via the lever 9. The upward movement of the scissor jack is supported by the load transmission roller 27 which maintains its contact with the facing side of the scissors-type member 14. A reversal of the gear motor 20 results in a collapse of the scissor jack so as to lower the head part 11, with the weight of the lifting apparatus 12 maintaining the contact between the scissors-type member 14 and the roller 27.

In the event an object obstructs the movement of the scissors-type members 13, 14 or of the head part 11, the force direction is reversed at this moment from tension force to pressure force in axial direction so that the spindle 19 and thus the disk 26 are axially moved in opposition to the action of the disk spring 27 to thereby disengage the disk 26 from the disk 25. This separation of the disks 25, 26 breaks the connection of the screw nut and the gear motor 23 so that not torque is transmitted to the screw nut and thus a further movement of the scissors-type members 13, 14 and of the head part 11 is immediately stopped. As soon as the obstruction is removed from the path of the head part 11 or the scissors-type members 13, 14, the disk spring 27 returns the disk 26 into interlocking engagement with the disk 25 to continue the adjustment of the head part 11. An abrupt collapse of the scissors-type members 13, 14 or a sudden drop of the head part 11 is thereby prevented.

Turning now again to FIG. 2, there is shown a further mechanical safety mechanism by which the lifting apparatus 12 is shielded from unintentional contact of the scissors-type members 13, 14. Mounted to the upper crossbar 15 of the scissor jack is a safety web 31 which is indicated in FIG. 2 only in dash-dot lines for sake of simplicity. Extending parallel to the lower crossbar 16 is a winding reel 32 which receives the other end of the safety web 31.

At operation, when the scissor jack is moved upwards with its scissors-type members 13, 14 to adjust the head part 11, the safety web 31 is rolled off from the reel 32 at the same time. Suitably, the reel 32 is provided with a spring (not shown) which is tensioned when the safety web 31 is unwound to permit a re-winding of the safety web 31 when the movement of the scissor jack is reversed and the scissors-type members 13, 14 collapse. Thus, the safety web 31 prevents objects such as e.g. the hand of a user from reaching into the path of movement of the scissors-type members 13, 14.

Figure 4:
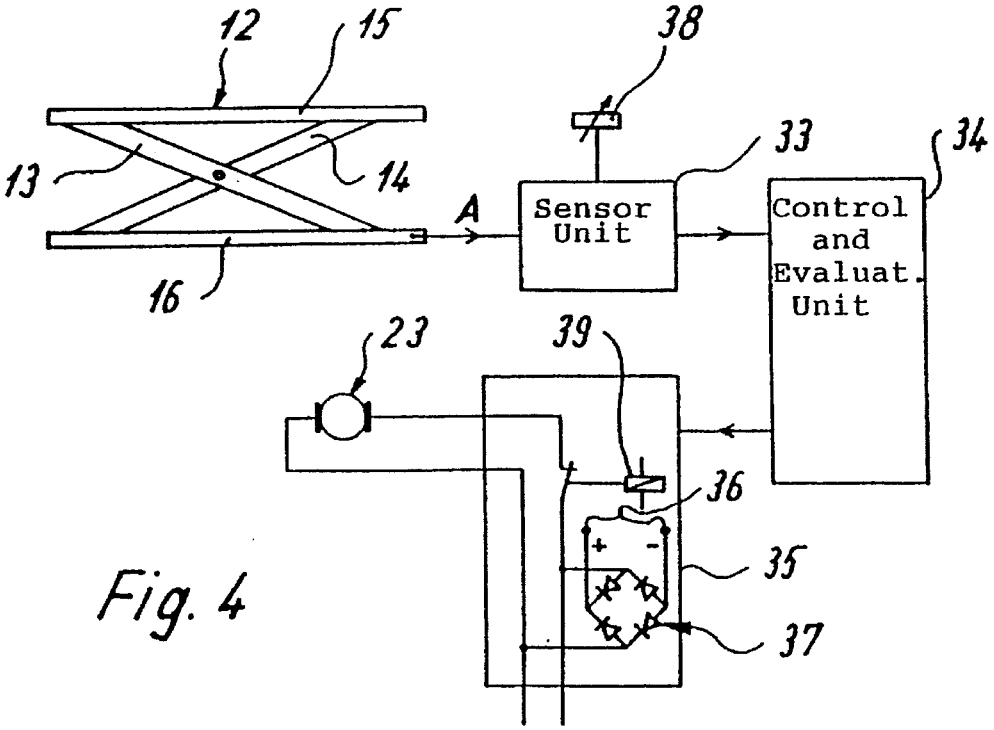
FIG. 4 is a schematic circuit and block diagram of another embodiment of a lifting apparatus, equipped with an electronic mechanism for controlling the lifting apparatus.

Turning now to FIG. 4, there is shown a schematic block and circuit diagram of an electronic safety mechanism for stopping the movement of the scissor jack upon blockage by an object. The lifting apparatus 12 includes a metallic scissor jack which is operatively connected to a sensor unit 33 to form a contact or approximation detector, as indicated by arrow A. In the event a metallic part of the scissor jack is contacted or approached by an object, the sensor unit 33 generates a signal which is amplified, screened and selected in a control and evaluation unit 34 and transmitted to a switching amplifier 35 for interruption of the current supply to the low-voltage d.c. gear motor 23. Thus, the d.c. gear motor 23 is immediately shut down. As indicated in FIG. 4 by reference numeral 36, the switching amplifier 35 also contains the current supply. A rectifier 37 in form of a bridge circuit formed from four metal or semi-conductor diodes rectifies the current. As illustrated in FIG. 4, the switching amplifier 35 is supplied with current from the motor line only when the gear motor 23 is in operation irrespective of its direction of rotation.

The contact or approximation detector comprised of sensor unit 33 and scissor jack is preferably designed in form of an inductive proximity switch, with the lifting apparatus 12 being the detector electrode. The sensitivity can be adjusted by means of a trimmer potentiometer 38 so that the circuitry is triggered already by approach of an object rather than by actual contact. The control and evaluation unit 34 is an amplifier with conventional anti-interference elements. The switching amplifier 35 includes a relay 39 placed in the motor line with a break contact which is matched with the power of the low-voltage d.c. gear motor 23. The current supply is taken from the motor line prior to the relay 39 and is rectified by the rectifier 37 independent of the direction of rotation of the gear motor 23. For safety reasons, when this safety mechanism fails to operate, the gear motor 23 cannot be actuated anymore.

While the invention has been illustrated and described as embodied in a lifting apparatus, it is not intended to be limited to the details shown since various modifications and structural changes may be made without departing in any way from the spirit of the present invention.

What is claimed as new and desired to be protected by Letters Patent is set forth in the appended claims:

I claim:

1. A lifting device for swiveling parts of a piece of furniture; comprising:

a scissor jack connected to a part being swiveled;

drive means for actuating said scissor jack, said drive means including a spindle and a gear motor connected to said scissor jack; and safety means incorporated in said drive means for stopping movement of said scissor jack upon occurrence of a blockage, said safety means including a pair of disks engaging each other during normal operation via a complementary tooth gearing extending about the perimeter of each said disk, with one of said disks being stationary and the other one of said disks being a spring-loaded disk which is displaceable in axial direction for allowing disengagement of said disks upon blockage of a downward movement.

2. A lifting apparatus as defined in claim 1 wherein said disks are provided in form of a ring gear.

3. A lifting apparatus for swiveling parts of a piece of furniture; comprising:

a metallic scissor jack connected to the part being swiveled;

drive means for actuating said scissor jack, said drive means including a spindle and a gear motor connected to said scissor jack; and safety means for stopping movement of said scissor jack upon occurrence of a blockage, said safety means including a sensor unit forming with said scissor jack a contact or approximation detector for generating a signal upon contact or approach of said scissor jack, and a control and evaluator unit receiving the signal from said sensor unit for generating control signals for said drive means, wherein said safety means includes a switching amplifier for enhancing the control signals of said control and evaluator unit and a power source incorporated in said switching amplifier so that a supply of power to said sensor unit and said control and evaluator unit is provided only when said drive means is operated.

4. A lifting apparatus for swiveling parts of a piece of furniture; comprising:

a metallic scissor jack connected to the part being swiveled;

drive means for actuating said scissor jack, said drive means including a spindle and a gear motor connected to said scissor jack; and safety means for stopping movement of said scissor jack upon occurrence of a blockage, said safety means including a sensor unit forming with said scissor jack a contact or approximation detector for generating a signal upon contact or approach of said scissor jack, and a control and evaluator unit receiving the signal from said sensor unit for generating control signals for said drive means, wherein said contact or approximation detector is an inductive proximity switch, with said scissor jack forming a detector electrode.

5. A lifting apparatus as defined in claim 4 wherein said switching amplifier includes a relay.

6. A lifting apparatus for swiveling parts of a piece of furniture; comprising:

a metallic scissor jack connected to the part being swiveled;

drive means for actuating said scissor jack, said drive means including a spindle and a gear motor connected to said scissor jack; and safety means for stopping movement of said scissor jack upon occurrence of a blockage, said safety means including a sensor unit forming with said scissor jack a contact or approximation detector for generating a signal upon contact or approach of said scissor jack, a control and evaluator unit receiving the signal from said sensor unit for generating control signals for said drive means, and a trimmer potentiometer for adjusting the sensitivity of said sensor unit.

7. A lifting device for swiveling a part of a piece of furniture; comprising:

a lifting member connected to the part being swiveled;

drive means for actuating said lifting member, said drive means including a spindle and a gear motor, said gear motor being connected to said lifting member and placed upon said spindle for axial movement along said spindle; and safety means operatively connected to said drive means for stopping a movement of said lifting member upon occurrence of a blockage, said safety means including a pair of disks rotatable about said spindle and engaging each other via a complementary tooth gearing, one of said disks being stationary and the other one of said disks being a spring-loaded disk and displaceable in axial direction relative to said one disk for allowing disengagement of said disks upon blockage of a movement of said lifting member.

8. A lifting apparatus as defined in claim 7, and further comprising a protective means for shielding said lifting member from outside, said protective means including a stationary reel and a safety web extending essentially over a width of said lifting member, said safety web having one end connected to said lifting member and another end secured to said reel for allowing winding and unwinding thereof in synchronism with a movement of said lifting member.

9. A lifting apparatus as defined in claim 7 wherein said lifting member is of metal, said safety means including a sensor unit forming with said lifting member a contact or approximation detector for generating a signal upon contact or approach of said lifting member, and a control and evaluator unit receiving the signal from said sensor unit for generating control signals for said drive means.

10. A lifting apparatus as defined in claim 9 wherein said safety means includes a switching amplifier for enhancing the control signals of said control and evaluator unit and a power source incorporated in said switching amplifier so that a supply of power to said sensor unit and said control and evaluator unit is provided only when said drive means is operated.

11. A lifting apparatus as defined in claim 9 wherein said contact and approximation detector is an inductive proximity switch, with the lifting member forming a detector electrode.

12. A lifting apparatus as defined in claim 9 wherein said safety means includes a trimmer potentiometer for adjusting a sensitivity of said sensor unit.

13. A lifting apparatus as defined in claim 9 wherein said switching amplifier includes a relay.

* * * * *